US005184741A

United States Patent [19]

Chevassus et al.

[11] Patent Number: 5,184,741

[45] Date of Patent: Feb. 9, 1993

[54] RECEPTACLE WITH ORIENTABLE SCREW-THREADED CAP

[75] Inventors: Alain Chevassus, Sceaux; Patrick Fraillon, Gonesse, both of France

[73] Assignee: Techpack International, TPI Societe Anonyme, Parigne L'Eveque, France

[21] Appl. No.: 743,249

[22] Filed: Aug. 9, 1991

[30] Foreign Application Priority Data

Aug. 17, 1990 [FR] France ..... 90 10413

[51] Int. Cl.[5] ..... B65D 41/04; B65D 55/02

[52] U.S. Cl. ..... 215/331; 215/329; 215/330; 215/217

[58] Field of Search ..... 215/204, 227, 277, 321, 215/329, 330, 331, 334, 335, 337

[56] References Cited

U.S. PATENT DOCUMENTS

| | | | |
|---|---|---|---|
| 4,090,629 | 5/1978 | Hedgewick | 215/214 |
| 4,093,096 | 6/1978 | Augros | 215/330 |
| 4,273,248 | 6/1981 | Lehmann | 215/331 |
| 4,289,248 | 9/1981 | Lynn | 215/330 |
| 4,494,665 | 1/1985 | Lehmann | 215/330 |
| 4,519,518 | 5/1985 | Wiles et al. | 215/331 |
| 4,534,477 | 8/1985 | Laub, III | 215/215 |
| 4,553,678 | 11/1985 | Thorsbakken | 215/218 |
| 4,620,640 | 11/1986 | Swartzbaugh | 215/217 |
| 4,770,308 | 9/1988 | Lynn | 215/330 |
| 4,877,144 | 10/1989 | Thanisch | 215/330 |

FOREIGN PATENT DOCUMENTS

| | | |
|---|---|---|
| 0007274 | 1/1980 | European Pat. Off. . |
| 2514327 | 4/1983 | France . |
| 2553382 | 4/1985 | France . |

*Primary Examiner*—Allan N. Shoap
*Assistant Examiner*—Vanessa Caretto
*Attorney, Agent, or Firm*—Young & Thompson

[57] ABSTRACT

The invention relates to a receptacle such as a perfume or cosmetic bottle, having a screw-threaded cap orientable relative to the receptacle. The receptacle has a screw neck (2) that has two symmetrical external screw threads (3, 4) each provided with an interruption (5) in the vicinity of the beginning of the thread (3, 4) and with a substantially axial abutment (6) in the vicinity of the end of the thread (3, 4). The cap has internally two symmetrical screw threads each comprising a catch (11) provided by one end of the thread and a substantially axial end (12) at the other end of the thread. The catch (11) is engageable in the interruption (5) and the abutment (6) and the thread end (12) are interengageable.

2 Claims, 3 Drawing Sheets

RECEPTACLE WITH ORIENTABLE SCREW-THREADED CAP

The invention relates to a receptacle, such as a perfume or cosmetic bottle, comprising a screw-threaded cap orientable relative to the receptacle.

It is often necessary that a screw-threaded cap of a receptacle, particularly a perfume or cosmetic bottle, be oriented in a precise manner relative to the receptacle. This requirement can be connected to a problem of appearance, the cap not being a figure of revolution and needing to have a predetermined position relative to the receptacle, or a technical problem such as the exposure of an aerosol nozzle. Such a cap however should be adapted to be unscrewed but should return to the desired position upon rescrewing.

This imposes a two-fold requirement, namely:

- to produce a precise and certain screw stop mechanically preventing any continuation of screwing no matter what force is applied,
- to prevent accidental unscrewing while permitting deliberate unscrewing.

The present invention accordingly seeks to provide a new receptacle of the type indicated in the introduction which will satisfy the two conditions independently of each other.

To this end, the receptacle according to the invention is characterized in that the screw neck of the receptacle comprises externally two symmetrical screw threads each provided with an interruption in the vicinity of the beginning of the thread and a substantially axial abutment in the vicinity of the end of the thread, the cap comprising a capsule provided internally with two symmetrical threads each comprising a catch at one end of the thread and a substantially axial thread When the capsule is completely screwed on the neck of the receptacle, usually a glass or plastic bottle, the catches of the capsule are disposed respectively in the interruptions of the screw threads of the receptacle and the thread ends of the capsule are in contact respectively with the abutments of the receptacle. This latter coaction of the abutments and thread ends prevents continuing screwing, the cap being oriented precisely relative to the receptacle. It is maintained in this position by the coaction of the catches of the capsule with the interruptions of the receptacle and cannot be unscrewed other than by exerting an unscrewing torque sufficient to disengage the catches from the interruptions. This torque can be predetermined by calibrating the thickness of the walls of the capsule adjacent the catches.

The cap can comprise a decorative over-capsule assembled by friction on the capsule with the help of corrugations and angularly positioned relative to the capsule by means of ribs on one of the members coacting with grooves on the other member.

The capsule can comprise in known manner an external joint for closing the receptacle.

The invention will be better understood from a reading of the following description given with reference to the accompanying drawing, in which.

Figure 1:
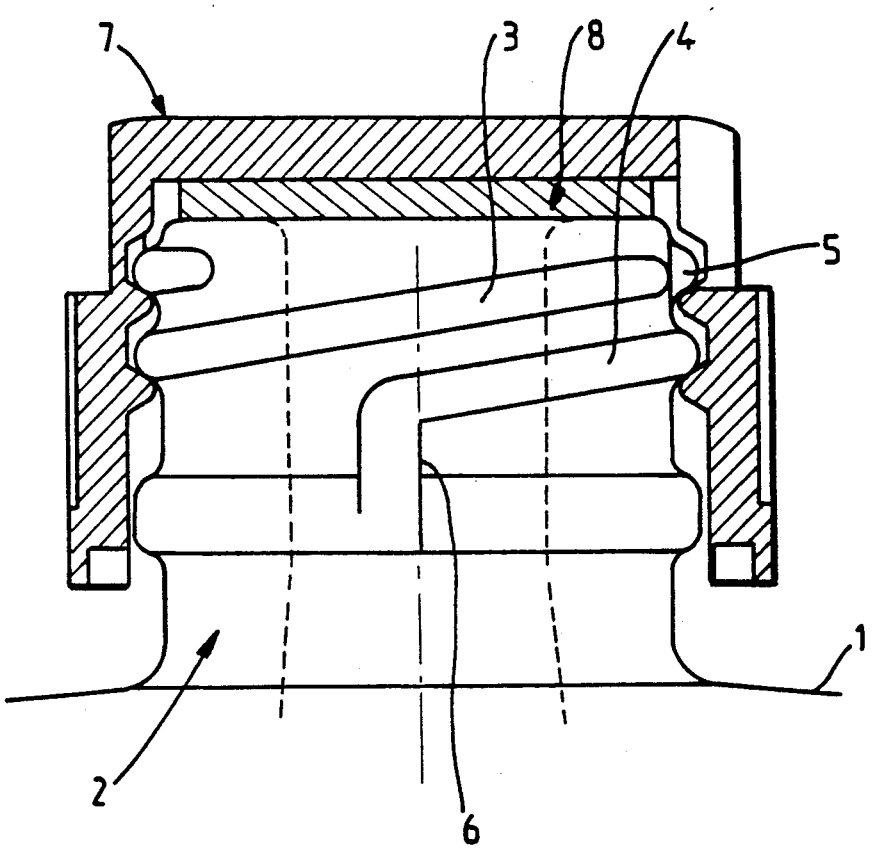
FIG. 1 is a schematic axial cross-sectional view, partially in elevation, of a receptacle neck with screw-threaded capsule orientable according to an embodiment of the invention.
Figure 4:
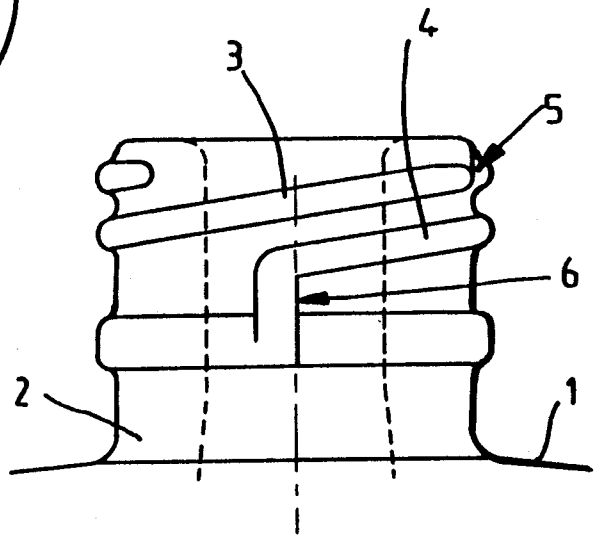
FIG. 4 is a view analogous to FIG. 2, but at 90° from this latter.
Figure 3:
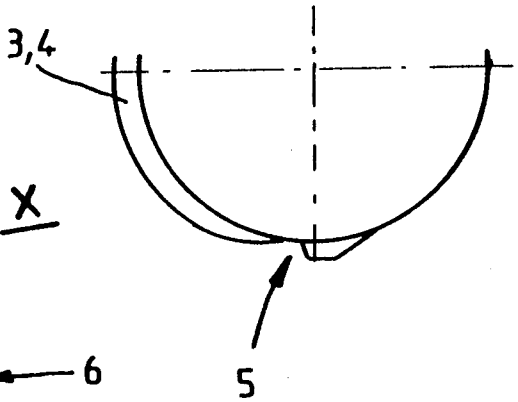
FIG. 3 is a cross-sectional view on line X—X of FIG. 2.
Figure 2:
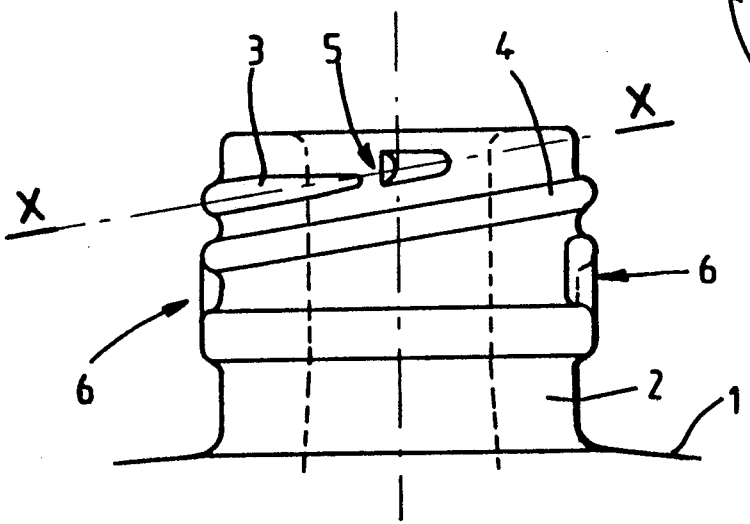
FIG. 2 is a schematic elevational view of the neck of the receptacle of FIG. 1.

The receptacle 1 comprises a neck 2 provided with two external symmetric screw threads 3 and 4. Each thread 3, 4 comprises an interruption 5 at the beginning of the thread and a substantially axial abutment 6 at the end of the thread.

A capsule 7 is screw threaded on neck 2 of the receptacle 1, with the interposition of a sealing joint 8.

Figure 6:
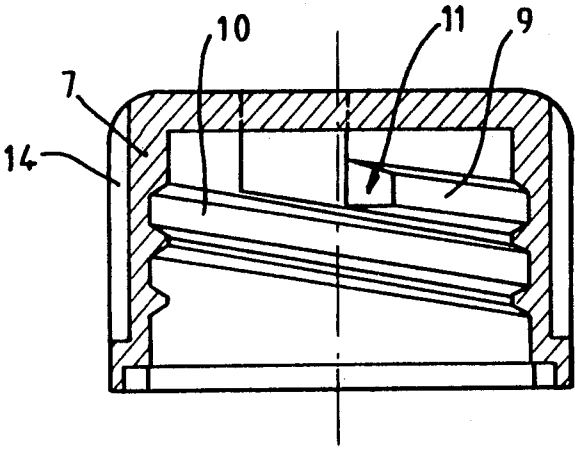
FIG. 6 is similar to FIG. 5, but at 90° to this latter.
Figure 5:
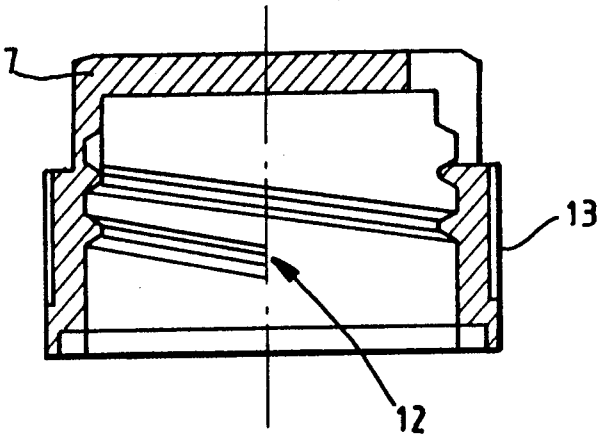
FIG. 5 is a schematic view in axial cross section of the capsule of FIG. 1.
Figure 7:
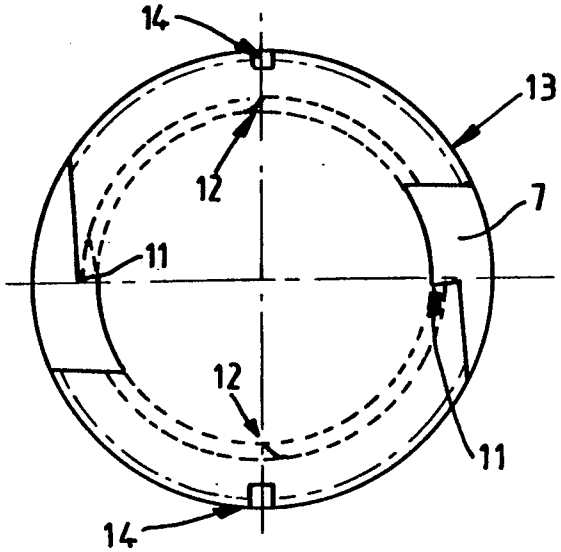
FIG. 7 is a transverse cross-sectional view of the capsule of FIGS. 5 and 6.

The capsule 7 has two symmetrical internal screw threads 9, 10 (FIGS. 5 to 7) each provided with an catch tooth 11, coacting each with an interruption 5 of the threads 3 and 4 of the receptacle 1, and a substantially axial end 12 of the thread each coacting with an abutment 6 of the threads 3 and 4 of the receptacle 1. As indicated in the introduction, there is thus obtained at the end of screwing simultaneously a positive abutment and an elastic locking of the capsule 7 relative to the neck 2 of the receptacle 1.

The capsule 7 comprises corrugations 13 serving for the frictional assembly of a decorative over-capsule (not shown) which is angularly positioned relative to the capsule 7 by means of grooves 14 in which come to rest the ribs of the over-capsule. The over-capsule, which alone is visible, is therefore thus automatically oriented relative to the neck 2 of the receptacle 1.

What is claimed is:

1. A receptacle with an open mouth and having a screwthreaded cap for closing said mouth and for orientation relative to said receptacle, said receptacle having a screw neck (2) which comprises externally two symmetrical screw threads (3, 4) each screw thread being provided with an interruption (5) adjacent said first end of the thread (3, 4) and with a substantially axial abutment (6) adjacent said second end of the thread (3, 4), the cap having a top surface having internally two symmetrical screw threads, each screw thread comprising a end and a second end, said first end being closer to said mouth, comprising a single catch (11) at said first end of the thread adapted to be received in said interruption and a substantially axial thread end (12) at said second end of the thread adapted to contact said axial abutment (6) to effect a locking of the cap on said receptacle by a simultaneous abutment of the substantially axial thread end (12) with said axial abutment (6) and an elastic locking of the interruption (5) with the non-return catch (11).

2. A receptacle according to claim 1, wherein the cap has an internal sealing joint (8) for closing said receptacle (1).

* * * * *